US009126072B2

(12) United States Patent
Watterson

(10) Patent No.: US 9,126,072 B2
(45) Date of Patent: Sep. 8, 2015

(54) FREE WEIGHT MONITORING SYSTEM

(71) Applicant: ICON Health & Fitness, Inc., Logan, UT (US)

(72) Inventor: Scott R. Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 159 days.

(21) Appl. No.: 13/872,859

(22) Filed: Apr. 29, 2013

(65) Prior Publication Data

US 2013/0288859 A1 Oct. 31, 2013

Related U.S. Application Data

(60) Provisional application No. 61/640,326, filed on Apr. 30, 2012.

(51) Int. Cl.

| | |
|---|---|
| ***A63B 24/00*** | (2006.01) |
| ***A63B 21/072*** | (2006.01) |
| ***A63B 71/06*** | (2006.01) |
| ***A63B 21/075*** | (2006.01) |

(52) U.S. Cl.

CPC ..... *A63B 24/0062* (2013.01); *A63B 21/075* (2013.01); *A63B 21/0726* (2013.01); *A63B 71/0622* (2013.01); *A63B 21/0724* (2013.01); *A63B 2071/068* (2013.01); *A63B 2071/0647* (2013.01); *A63B 2071/0683* (2013.01); *A63B 2207/00* (2013.01); *A63B 2220/40* (2013.01); *A63B 2220/52* (2013.01); *A63B 2220/803* (2013.01); *A63B 2220/89* (2013.01); *A63B 2225/20* (2013.01); *A63B 2225/50* (2013.01); *A63B 2225/54* (2013.01)

(58) Field of Classification Search

CPC ..... A63B 24/0062; A63B 2225/50; A63B 2225/20; A63B 22/0605; A63B 71/0622; A63B 24/00; A63B 24/0075; A63B 2071/0658; A63B 2021/0626

USPC ..... 482/8, 1–7, 9, 92–94, 106–108

See application file for complete search history.

(56) References Cited

U.S. PATENT DOCUMENTS

| | | | | |
|---|---|---|---|---|
| 5,868,653 | A * | 2/1999 | Klasen | 482/110 |
| 6,251,048 | B1 | 6/2001 | Kaufman | |
| 6,342,028 | B1 * | 1/2002 | de Sane | 482/1 |
| 7,455,621 | B1 * | 11/2008 | Anthony | 482/8 |
| 7,578,771 | B1 * | 8/2009 | Towley et al. | 482/106 |
| 8,111,166 | B2 | 2/2012 | Flexer et al. | |
| 8,572,764 | B2 * | 11/2013 | Thellmann | 2/161.1 |
| 2002/0128127 | A1 * | 9/2002 | Chen | 482/106 |
| 2003/0100406 | A1 * | 5/2003 | Millington et al. | 482/1 |

(Continued)

FOREIGN PATENT DOCUMENTS

WO WO 0053266 A1 * 9/2000

*Primary Examiner* — Loan H Thanh
*Assistant Examiner* — Andrew S Lo
(74) *Attorney, Agent, or Firm* — Holland & Hart LLP

(57) ABSTRACT

A free weight system for collecting and transmitting exercise related data from a free weight device includes a free weight handle assembly having a gripping portion and a weight receiving portion, one or more weight plates positionable on the weight receiving portions, and a data collecting mechanism at least partially enclosed within an internal cavity of the free weight handle assembly. The data collecting mechanism includes a weight identification mechanism that identifies the weight of the one or more weight plates.

17 Claims, 8 Drawing Sheets

(56) References Cited

U.S. PATENT DOCUMENTS

| | | | | |
|---|---|---|---|---|
| 2005/0065003 | A1* | 3/2005 | Klotzki | 482/107 |
| 2005/0227831 | A1* | 10/2005 | Mills et al. | 482/106 |
| 2005/0233871 | A1* | 10/2005 | Anders et al. | 482/93 |
| 2006/0084422 | A1* | 4/2006 | Huang et al. | 455/420 |
| 2006/0240959 | A1* | 10/2006 | Huang | 482/108 |
| 2007/0135264 | A1 | 6/2007 | Rosenberg | |
| 2008/0146418 | A1* | 6/2008 | Summers | 482/91 |
| 2009/0069722 | A1 | 3/2009 | Flaction et al. | |
| 2009/0197745 | A1* | 8/2009 | Olson | 482/107 |
| 2011/0112771 | A1 | 5/2011 | French | |
| 2012/0129653 | A1* | 5/2012 | Shalev et al. | 482/1 |
| 2012/0295774 | A1* | 11/2012 | Dalebout et al. | 482/106 |
| 2013/0090212 | A1* | 4/2013 | Wang | 482/8 |

* cited by examiner

FREE WEIGHT MONITORING SYSTEM

CROSS-REFERENCE TO RELATED APPLICATIONS

This application claims priority to U.S. Provisional Patent Application No. 61/640,326 filed Apr. 30, 2012.

TECHNICAL FIELD

In general, the present invention relates to exercise related systems. More specifically, the present invention relates to free weight systems where data regarding the use of a free weight device can be collected and transmitted.

BACKGROUND

Free weight devices, including for example dumbbells, barbells, curl bars, and the like are well known in the art and are widely used as part of many weight-based exercise sessions. Free weight devices may allow a user to secure a desired amount of weight to the free weight bar. Exercise sessions using free weight devices often involve performing a number of repetitive movements while holding the weight bar. Exercise sessions using free weight devices often require an individual to track the number of repetitive movements (or "repetitions") that are required to complete the session. Form and technique are very important in order to ensure that the proper muscle groups are targeted and to avoid injury.

Mechanisms exist that assist individuals in keeping a correct count of the number of repetitions performed. For example, U.S. Pat. No. 6,251,048, U.S. Patent Application Publication No. 2007/0135264, U.S. Patent Application Publication No. 2008/0204255, U.S. Patent Application Publication No. 2009/0069722, and U.S. Patent Application Publication No. 2011/0112771 each disclose devices that track and measure movements, such as repetitions performed, and transmit this information to an external computing device. These devices may be integrated into an article of clothing worn by an individual, such as a glove, or affixed to a part of an exercise device, such as a weight plate or a free weight handle assembly. Integrating these mechanisms into an article of clothing that is worn by an individual or affixing these mechanisms to an outer surface of an exercise device may cause an interference with the individual's exercise session. For example, the device may preclude the individual from gripping the exercise device in a desired location. In addition, the device may limit an individual's range of movement.

Also, these devices, whether integrated into an article that is worn by an individual or affixed to an outer surface of an exercise device, may track and measure movement that is unrelated to the exercise session. For example, a mechanism that is affixed to a weight plate on a free weight device may track movement of the plate relative to the bar. Specifically, the plate may rotate relative to the bar during an exercise session. This rotation may create errors in the data collected.

SUMMARY

In one embodiment, a free weight system for collecting and transmitting exercise related data from a free weight device includes a free weight handle assembly that includes a gripping portion, a left weight receiving portion, and a right weight receiving portion, the gripping portion being positioned between the left and right weight receiving portions and the free weight handle assembly defines an internal cavity. The free weight device also includes one or more weight plates that are positionable on the left and right weight receiving portions. The free weight device also includes a data collecting mechanism that is at least partially enclosed within the internal cavity. The data collecting mechanism includes a weight identification mechanism that identifies the weight of the weight plates.

In another aspect that may be combined with any of the aspects herein, the free weight device further includes a communication mechanism that transmits data collected by the data collecting mechanism to an external computing device.

In another aspect that may be combined with any of the aspects herein, the data collecting mechanism further comprises a movement sensing mechanism that senses movement of the free weight handle assembly.

In another aspect that may be combined with any of the aspects herein, the movement sensing mechanism comprises a first accelerometer that measures movement in a first direction, a second accelerometer that measures movement in a second direction, a third accelerometer that measures movement in a third direction.

In another aspect that may be combined with any of the aspects herein, the data collecting mechanism further comprises an exercise session identification mechanism that identifies the initiation and termination of an exercise session.

In another aspect that may be combined with any of the aspects herein, the exercise session identification mechanism comprises a button positioned on a surface of the free weight handle assembly.

In another aspect that may be combined with any of the aspects herein, the exercise session identification mechanism comprises a button that is positioned on a glove external to the free weight handle assembly.

In another aspect that may be combined with any of the aspects herein, the weight identification mechanism comprises a panel secured to a surface of the free weight handle assembly, the panel having one or more buttons that may be used to identify an amount of weight of the one or more weight plates.

In another aspect that may be combined with any of the aspects herein, the panel further comprises a display screen.

In another aspect that may be combined with any of the aspects herein, the weight identification mechanism comprises one or more sensors and wherein the at least one weight plate includes a transmitter that transmits to the sensor an amount of weight.

In another aspect that may be combined with any of the aspects herein, the transmitter on the at least one weight plate transmits data to the sensor via an RFID transmission.

In another aspect that may be combined with any of the aspects herein, the one or more sensors are located on or within the left or right weight receiving portion of the free weight handle assembly.

In another aspect that may be combined with any of the aspects herein, the data collecting mechanism further comprises a memory where data collected from at least one of the movement sensing mechanism and the weight identification mechanism is stored.

In another aspect that may be combined with any of the aspects herein, at least a portion the data stored within the memory is transmitted via the communication mechanism to the external computing device.

In another aspect that may be combined with any of the aspects herein, the communication mechanism transmits said at least a portion the data stored within the memory via a wireless communication link.

In another aspect that may be combined with any of the aspects herein, the free weight device further includes a battery that is least partially enclosed within the internal cavity, a charging port in electrical communication with the battery, and a base member upon which the free weight handle assembly may rest while not in use. Wherein, the base member includes a charging plug that mates with the charging port when the free weight handle is resting on the base member such that the battery can be recharged while the free weight handle rests on the base member.

In another aspect that may be combined with any of the aspects herein, the free weight device further includes a communication system that receives the data collected by the movement sensing mechanism and transmitted by the communication mechanism, wherein the communication system converts the data received into a displayable form that includes a graphical representation of the exercise session and makes the graphical representation available for viewing.

In another aspect that may be combined with any of the aspects herein, the graphical representation includes a three dimensional representation of the actual path of movement of the free weight device during the exercise session.

In another aspect that may be combined with any of the aspects herein, the communication system creates an ideal path of movement for the free weight device during the exercise session.

In another aspect that may be combined with any of the aspects herein, the actual path of movement and the ideal path of movement are overlaid within the same graphical display.

In another aspect that may be combined with any of the aspects herein, the communication system is a website.

DETAILED DESCRIPTION

Figure 1:
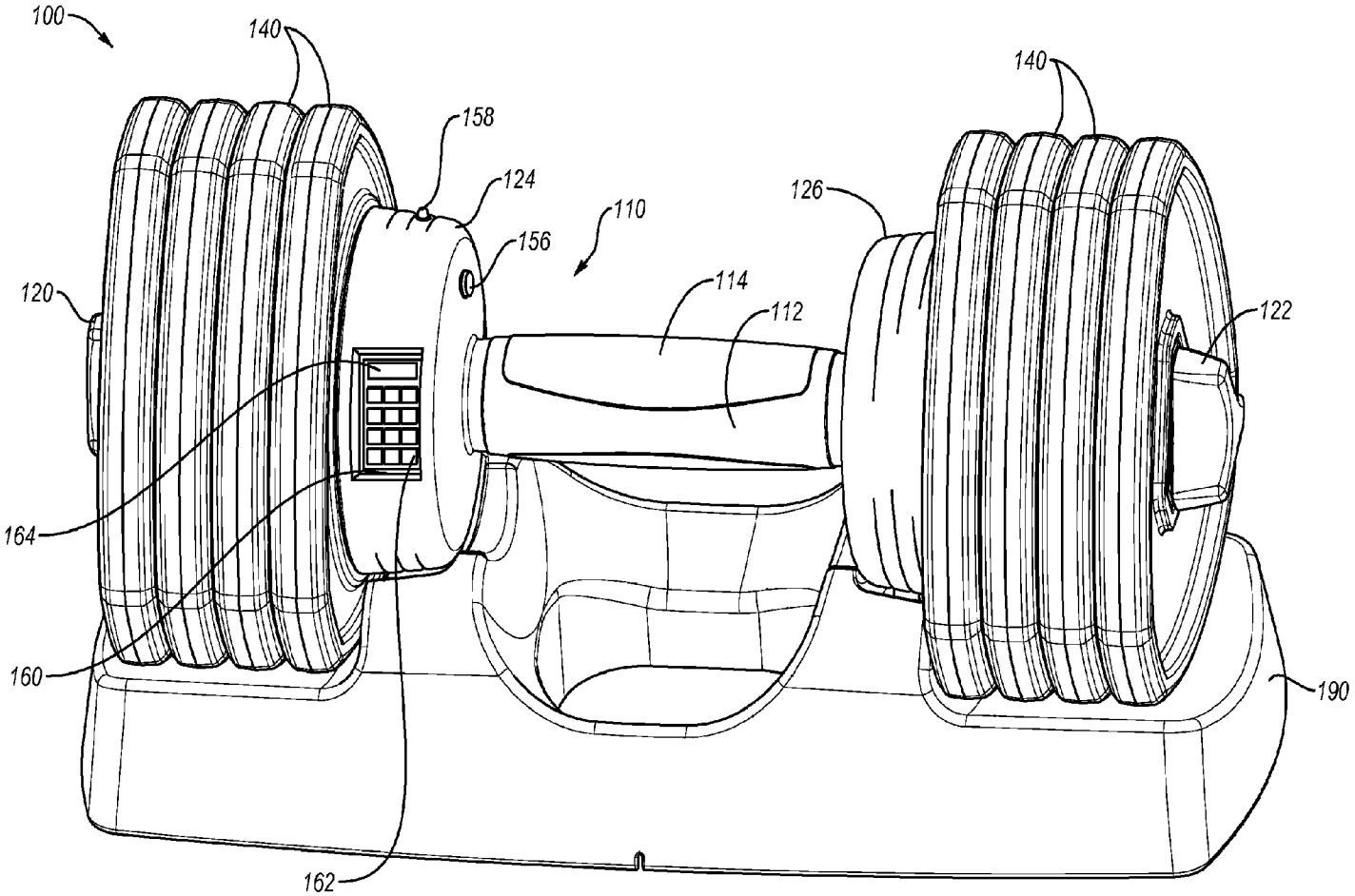
FIG. 1 illustrates a perspective view of a free weight system according to the present invention.
Figure 2:
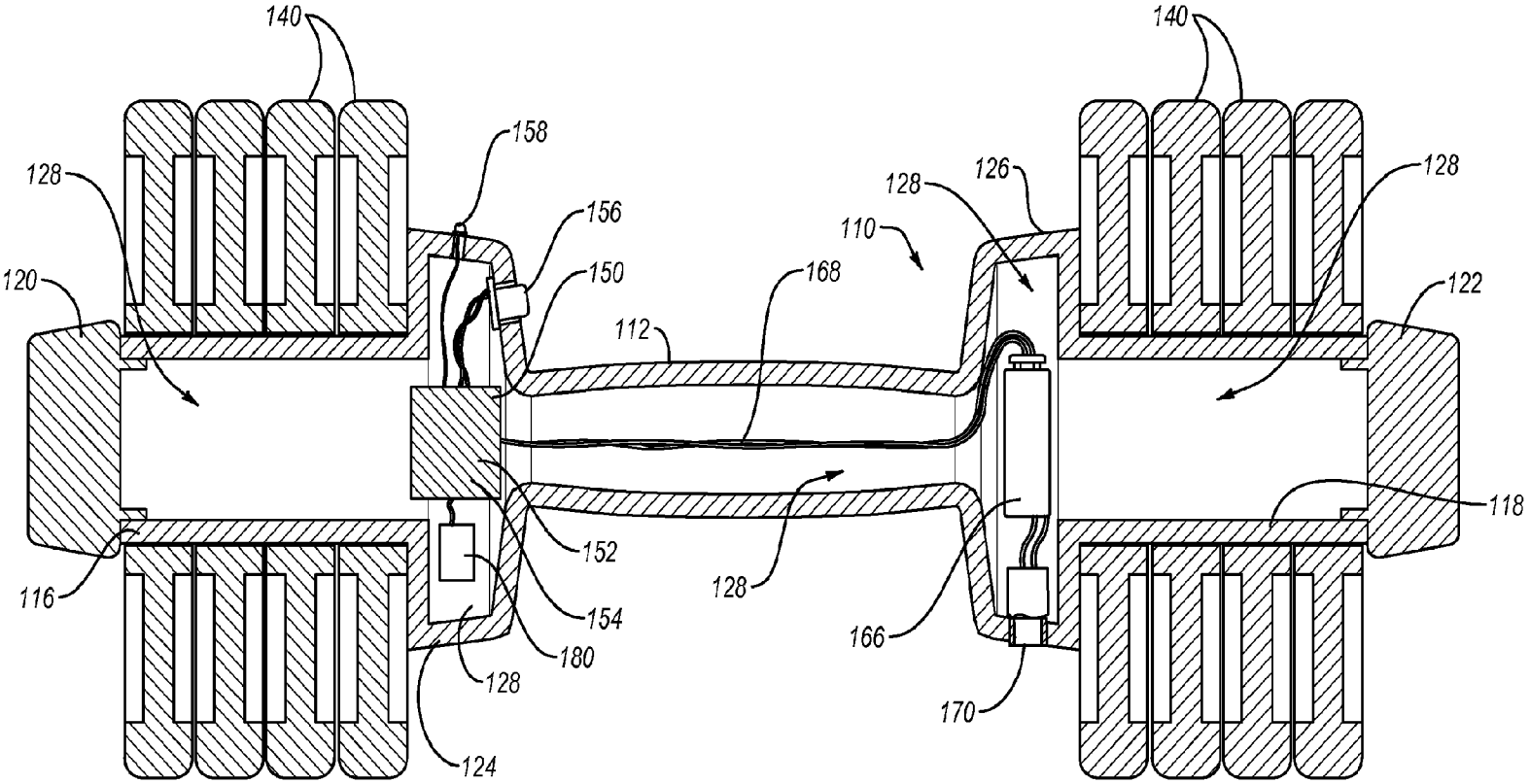
FIG. 2 illustrates a cross-sectional view of the free weight handle assembly and weight plates of the free weight system of FIG. 1.
Figure 3:
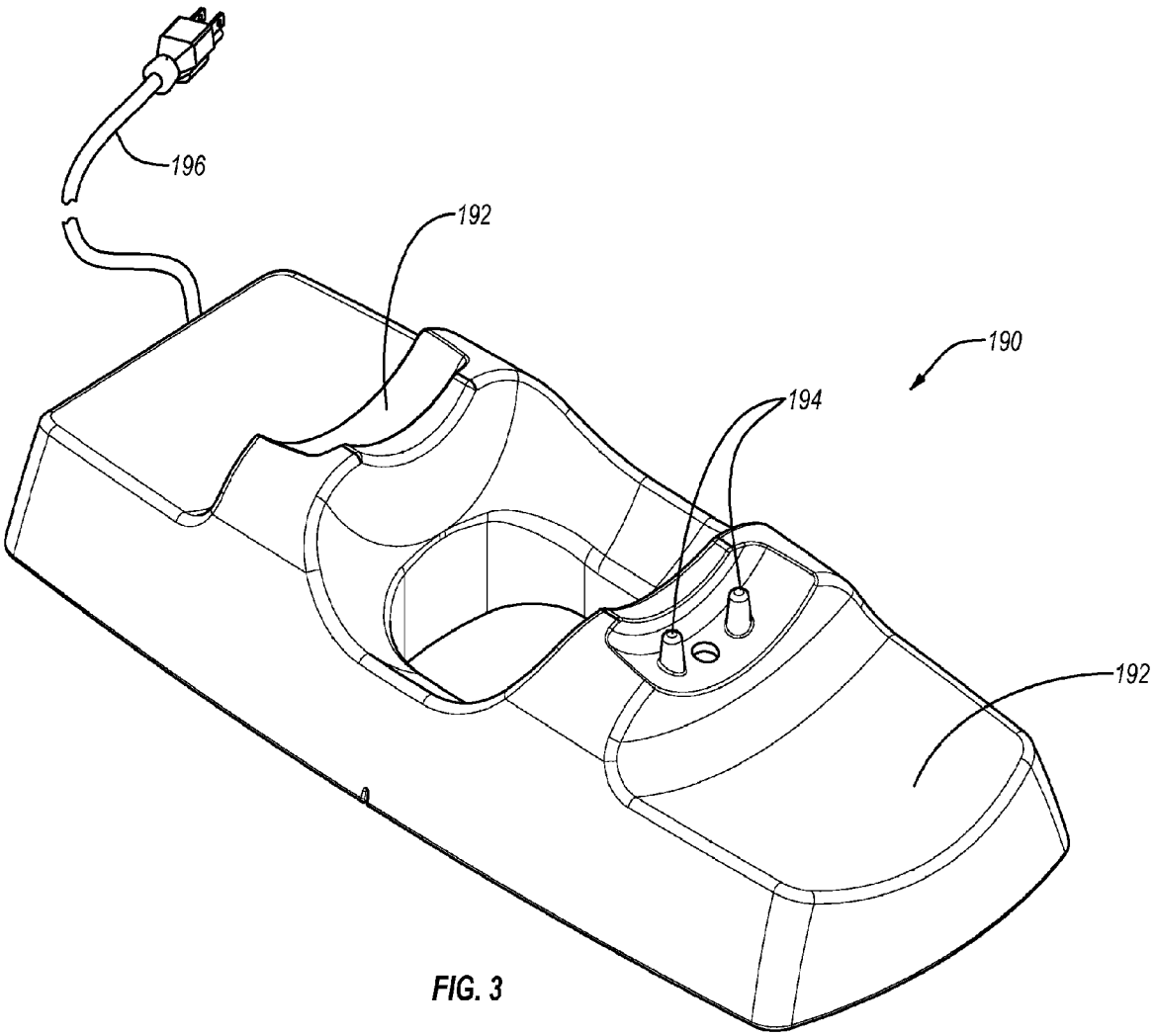
FIG. 3 illustrates a perspective view of the base member of the free weight system of FIG. 1.

FIGS. 1-3 illustrate an exemplary free weight system 100 according to the present invention. Specifically, free weight system 100 includes a free weight handle assembly 110, weight plates 140, a data collecting mechanism 150, a communication mechanism 180, and a base member 190. In general, data collecting mechanism 150 collects exercise related data and communication mechanism 180 transmits the collected data to an external computing device for storage, analysis, and/or display.

Free weight handle assembly 110 includes a gripping portion 112. Free weight handle assembly 110 is configured as a dumbbell with gripping portion 112 being generally sized in length and circumference to be held by one hand. Gripping portion 112 can include a slip resistant surface 114. Slip resistant surface 114 may cover all or a part of gripping portion 112. Slip resistant surface 114 can assist in providing a secure grip for a user during an exercise. For example, slip resistant surface 114 can include a textured surface or it can be made from a non-slip material, such as rubber or foam.

As shown in FIG. 2, free weight handle assembly 110 also includes a left weight receiving portion 116 and a right weight receiving portion 118, which are connected to and positioned to a left and right side of gripping portion 112. Left and right weight receiving portions 116 and 118 are configured to receive one or more weight plates 140. Specifically, weight plates 140 may have an aperture through which the left and right weight receiving portions 116 and 118 may be positioned. Left and right receiving portions 116 and 118 may have a variety of differently shaped cross sections. For example, left and right receiving portions 116 and 118 may have triangular, circular, rectangular, or other cross sectional shapes. The apertures in weight plates 140 may correspond to the cross sectional shapes of left and right receiving portions 116 and 118 such that left and right receiving portions 116 and 118 may be positioned through the apertures in weights plates 140.

Depending on the number of plates and the weight of each, an individual may place a desired amount of weight on free weight handle assembly 110. A left cap member 120 and right cap member 122 may be used to secure weight plates 140 on left and right receiving portions 116 and 118. For example, left and right cap members 120 and 122 may include an external threaded portion that mates with a threaded portion within left and right receiving portions 116 and 118.

Free weight handle assembly 110 also includes a left collar member 124 and a right collar member 126. Left and right collar members 124 and 126 are connected to gripping portion 112 and left and right weight receiving portions 116 and 118. Specifically, left collar member 124 is positioned between a left side of gripping portion 112 and left weight receiving portion 116. Right collar member 126 is positioned between a right side of gripping portion 112 and right weight receiving portion 118. Left and right collar members 124 and 126 may prevent weight plates 140 from sliding over gripping portion 112.

Each of the components of free weight handle assembly 110, specifically, left and right collar members 124 and 126, left and right weight receiving portions 116 and 118, and gripping portion 112 can be formed integrally as a single unit. Alternatively, these components can be formed separately and fastened together, either directly or indirectly, during a manufacturing process. Regardless of how free weight handle assembly 110 is made, an internal cavity 128 is defined within free weight handle assembly 110. Internal cavity 128 spans into or through each component of free weight handle assembly 110. Thus, gripping portion 112, left and right weight receiving portions 116 and 118, and left and right collar members 124 and 126 each define a portion of internal cavity 128. Internal cavity 128 houses, at least partially, data collecting mechanism 150 and communication mechanism 180.

Data collecting mechanism 150 includes a movement sensing mechanism 152. A movement sensing mechanism can be any device capable of sensing movement of free weight handle assembly 110. For example, movement sensing mechanism 152 may comprise one or more accelerometers, gyroscopes, and the like. Movement sensing mechanism 152 may detect the completion of one or more repetitions during an exercise session. In addition, movement sensing mechanism 152 may sense movement in more than one direction. For example, movement sensing mechanism 152 may comprise one or more accelerometers that sense movement in three different directions. Specifically, movement sensing mechanism 152 may comprise a first accelerometer that tracks movement in a first direction, as second accelerometer that tracks movement in a second direction, and a third accelerometer that tracks movement in a third direction. Sensing movement in three different directions may allow movement sensing mechanism 152 to track upward and downward movement, movement from side to side, and movement forward and backward. As described in more detail hereafter, this data may be used to create a three-dimensional model of the movement of free weight handle assembly 110.

Data collecting mechanism 150 also includes a timer 154. Timer 154 may track the amount of time that elapses during an exercise session. Timer 154 may also track the amount of time that elapses between events that are sensed by movement sensing mechanism 152. For example, timer 154 may track the amount of time between repetitions during an exercise session. Timer 154 may also track the amount of time it takes a user to raise free weight handle assembly 110 and to lower free weight handle assembly 110 during repetitions.

Data collecting mechanism 150 also includes an exercise session identification mechanism 156. Exercise session identification mechanism 156 may be communicatively connected to one or more components within data collecting mechanism 150. An exercise session identification mechanism may be any mechanism that identifies the initiation and/or termination of an exercise session and communicates the same to data collecting mechanism 150. Identifying the initiation and/or termination of an exercise session and communicating the same to data collecting mechanism 150 may allow data collecting mechanism 150 to only collect data that is relevant to an exercise session. For example, movement sensing mechanism 152 may begin sensing and tracking movement of free weight handle assembly 110 only during an exercise session. This would allow all movement of free weight handle assembly 110, which is not part of the exercise session, to be ignored. For example, movement from a weight rack to a bench or another area selected to perform the exercise session would not be sensed or tracked by movement sensing mechanism 152.

Exercise session identification mechanism 156 may use any number of different structures to signal the initiation or completion of an exercise session. For example, buttons, switches, rheostats, potentiometers, touch sensitive controls, voice activated controllers, and the like may be used to signal the initiation or completion of an exercise session. The exercise session identification mechanism 156 on free weight handle assembly 110 comprises a button on left collar member 124. Pressing this button may signal the initiation and/or completion of an exercise session.

An indicator 158 may provide notice to an exercising individual that the exercise session has been initiated. Specifically, indicator 158 in free weight system 100 includes a light that may illuminate when exercise session identification mechanism 156 receives a signal that an exercise session has been initiated. Indicator 158 may dim when exercise session identification mechanism 156 receives a signal that an exercise session has been terminated.

Data collecting mechanism 150 also includes a weight identification mechanism 160. A weight identification mechanism can be any mechanism that identifies the amount of weight that is secured to weight receiving portions on a free weight handle assembly. For example, weight identification mechanism in free weight system 100 comprises a panel secured to left collar member 124, which includes several buttons 162 and a display screen 164. An individual may input the amount of weight on left and right weight receiving portions 116 and 118 using buttons 162. Display screen 164 may display the amount of weight entered via buttons 162 to provide a visual representation of the amount of weight and to ensure accuracy.

Data collecting mechanism 150 also includes a battery 166 that is electrically connected to one or more of movement sensing mechanism 152, timer 154, exercise session identification mechanism 156, indicator 158, weight identification mechanism 160, and communication mechanism 180 via a wire 168. Battery 166 can be a lithium-ion battery, an alkaline battery, or another type of battery. Battery 166 can also be rechargeable. For example, to recharge battery 166, an individual may remove battery 166 from internal cavity 128 and connect it to an external recharging device. Alternatively, battery 166 can be configured to be recharged while remaining within internal cavity 128. Specifically, battery 166 can be in electric communication with a charging port 170. As will be discussed in greater detail below in connection with FIG. 3, charging port 170 can be compatible with any number of different charging plugs.

While each component of data collecting mechanism 150 is either within internal cavity 128 or secured to free weight handle assembly 110, this configuration is not necessary. Indeed, one or more components of a data collecting mechanism may be external to and/or separate from a free weight handle assembly. For example, as will be discussed in more detail in connection with FIG. 7, an exercise session identification mechanism may be located on a glove.

As noted, free weight system 100 also includes communication mechanism 180. A communication mechanism can be any mechanism that is configured to transmit data from a data collecting mechanism to an external computing device. For example, communication mechanism 180 in free weight system 100 wirelessly communicates with an external computing device. Communication mechanism 180 may comprise a Bluetooth, WiFi, or another wireless connecting technology.

As also noted, free weight system 100 further includes a base member 190. FIG. 3 provides a perspective view of base member 190. Base member 190 can be shaped such that free weight handle assembly 110 can rest on top of base member 190 when not in use. For example, base member 190 may have one or more recesses 192 that are shaped to receive and cradle components of free weight handle assembly 110 or weight plates 140. Base member 190 may also include a charging plug 194. Charging plug 194 can be configured to mate with charging port 170 in order to charge battery 166 while free weight handle assembly 110 is resting on the base member 190. The base member 190 can further include a cord 196 that plugs into an outlet to provide power to the charging plug 194.

Figure 4A:
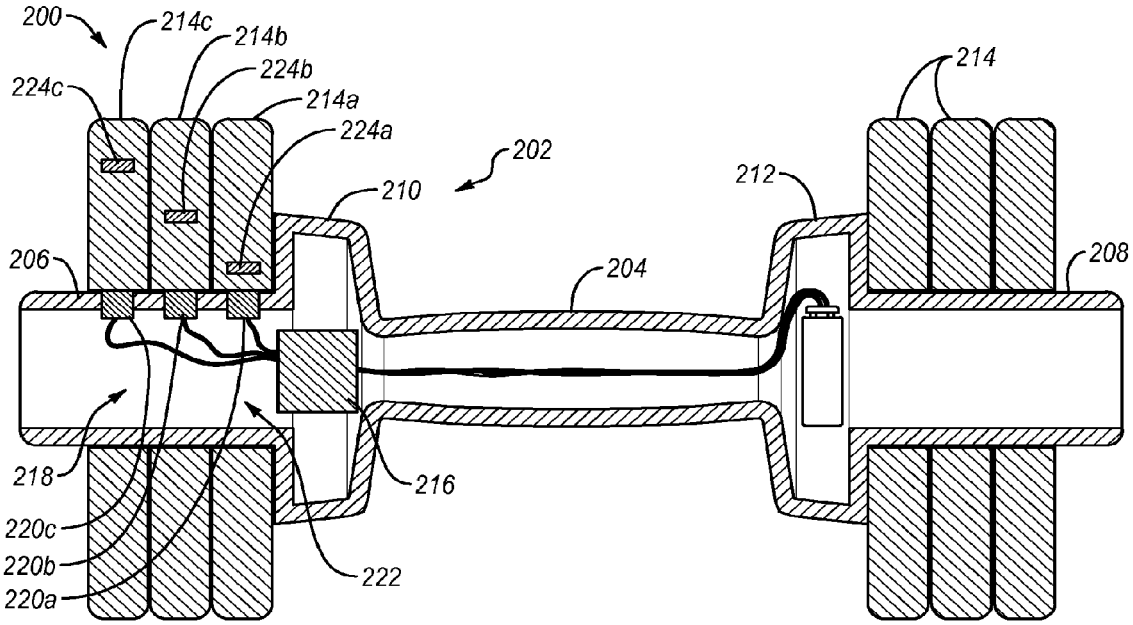
FIG. 4A illustrates a cross-sectional view of another free weight system according to the present invention.
Figure 4B:
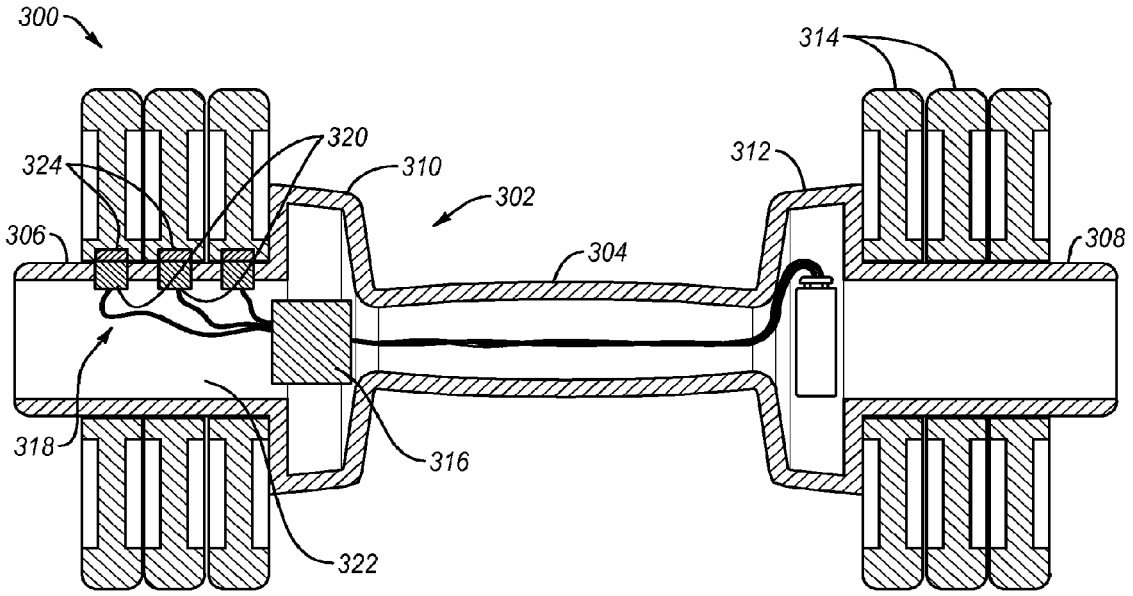
FIG. 4B illustrates a cross-sectional view of yet another free weight system according to the present invention.
Figure 4C:
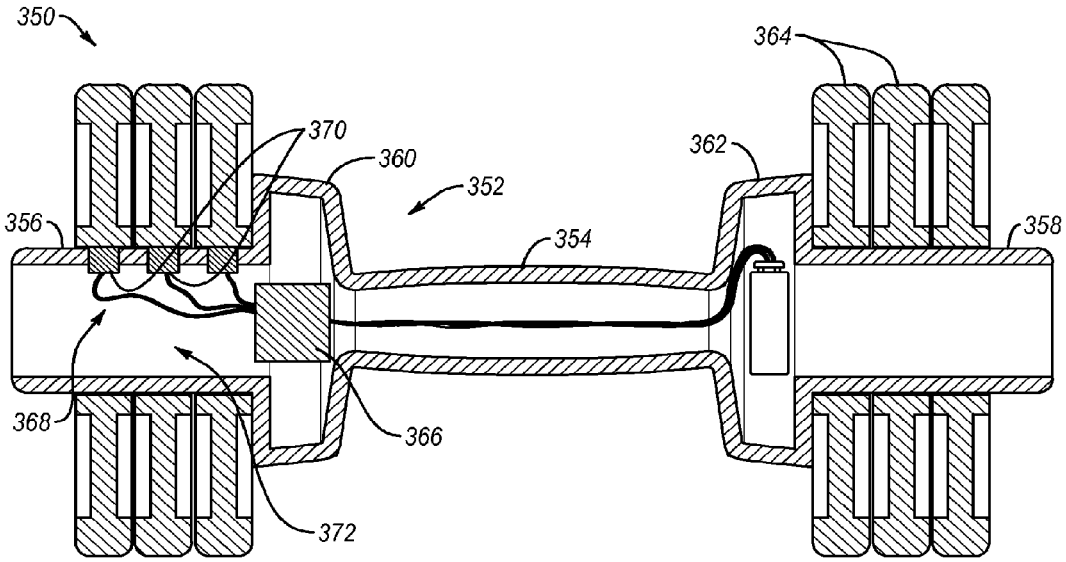
FIG. 4C illustrates a cross-sectional view of yet another free weight system according to the present invention.

FIGS. 4A, 4B and 4C illustrate cross sectional views of free weight systems 200, 300, and 350. Free weight systems 200, 300 and 350 are similar in many regards to free weight system 100. For example, free weight systems 200, 300, and 350 include free weight handle assemblies 202, 302, and 352 which comprise gripping portions 204, 304 and 354, left weight receiving portions 206, 306, and 356, right weight receiving portions 208, 308, and 358, left collar members 210, 310, and 360, and right collar members 212, 312, and 362. Free weight systems 200, 300 and 350 also include weight plates 214, 314, and 364, respectively. Free weight systems 200, 300, and 350 further include data collecting mechanisms 216, 316, and 366, which comprise weight identification mechanisms 218, 318, and 368, among other components. Unlike free weight system 100, however, weight identification mechanisms 218, 318, and 368 of free weight systems 200, 300, and 350 automatically sense weight amounts without the need for user input.

Specifically, weight identification mechanism 218 on free weight system 200 comprises one or more sensors 220 enclosed in part or in whole within an internal cavity 222 in left weight receiving portion 206. Sensors 220 may sense a magnetic field from one or more magnets 224, which are located within weight plates 214. Magnets 224 may be positioned within weight plates 214 so that differing distances separate magnets 224 from sensors 220. For example, magnet 224*a* within weight plate 214*a* is at a first distance from sensor 220*a*. Magnet 224*b* within weight plate 214*b* is at a second distance from sensor 220*b*, which is greater than the distance between magnet 224*a* and sensor 220*a*. Magnet 224*c* within weight plate 214*c* is at a third distance from sensor 220*c*. The distance between magnet 224*c* and sensor 220*c* is greater than both the distance between magnet 224*a* and sensor 220*a* and the distance between magnet 224*b* and sensor 220*b*. The distance between magnets 224 and sensors 220 may determine the strength of the magnetic field detected by sensors 220. Specifically, as the distance between magnets 224 and sensors 220 increases, the strength of the magnetic field decreases. The placement of magnets 224 within weight plates 214 may be based upon the weight of weight plates 214. Thus, by sensing the strength of the magnetic field, the weight of each weight plate may be determined.

Sensors 220 may be located on both left and right weight receiving portions 206 and 208. Alternatively, sensors 220 may be positioned in only one of left and right side weight receiving portions 206 and 208, as illustrated in FIG. 4A. To the extent that sensors are placed in only a left or right side weight receiving member, it may be assumed that the same amount of weight is secured to both left and right weight receiving members. Thus, the amount of weight sensed on one side may simply be doubled to determine the amount of weight secured to both left and right weight receiving members. Alternatively, a transmitter may be configured to transmit double the amount of actual weight so that in a system where only weight on one side of a weight bar is detected an accurate amount of weight may be determined.

Weight identification mechanism 318 on free weight system 300 comprises one or more sensors 320 enclosed in part or in whole within an internal cavity 322 in left weight receiving portion 306. Sensors 320 may receive a wireless transmission from one or more transmitters 324, which are located on at least one inner side of weight plates 314. Sensors 320 and transmitters 324 may be positioned such that when weight plates 314 are secured to left weight receiving portion 306, sensors 320 and transmitters 324 are sufficiently proximate that information regarding the amount of weight of weight plates 314 may be transmitted and received. Transmitters 324 and sensors 320 may communicate via a Bluetooth, RFID, IR, or other wireless mechanism.

Sensors 320 may be located on both left and right weight receiving portions 306 and 308. Alternatively, sensors 320 may be positioned in only one of left and right weight receiving portions 306 and 308, as illustrated in FIG. 4B. To the extent that sensors are place in only a left or right side weight receiving portion, it may be assumed that the same amount of weight is secured on both the left and right sides. Thus, the amount of weight sensed on one side may simply be doubled to determine the amount of weight secured to both left and right weight receiving members. Alternatively, a transmitter may be configured to transmit double the amount of actual weight so that in a system where only weight on one side of a weight bar is detected an accurate amount of weight may be determined.

Weight identification mechanism 368 on free weight system 350 comprises one or more sensors 370 enclosed in part or in whole within an internal cavity 372 in left weight receiving portion 356. Sensors 370 may comprise pressure switches. Sensors 370 may be positioned such that when weight plates 364 are secured to left weight receiving portion 356, sensors 370 are able to sense and measure the pressure of weight plates 364, thereby determining their weight. Sensors 370 may be located on both left and right weight receiving portions 356 and 358. Alternatively, sensors 370 may be positioned in only one of left and right weight receiving portions 356 and 358, as illustrated in FIG. 4C. To the extent that sensors are place in only a left or right side weight receiving portion, it may be assumed that the same amount of weight is secured on both the left and right sides. Thus, the amount of weight sensed on one side may simply be doubled to determine the amount of weight secured to both left and right weight receiving members.

Figure 5:
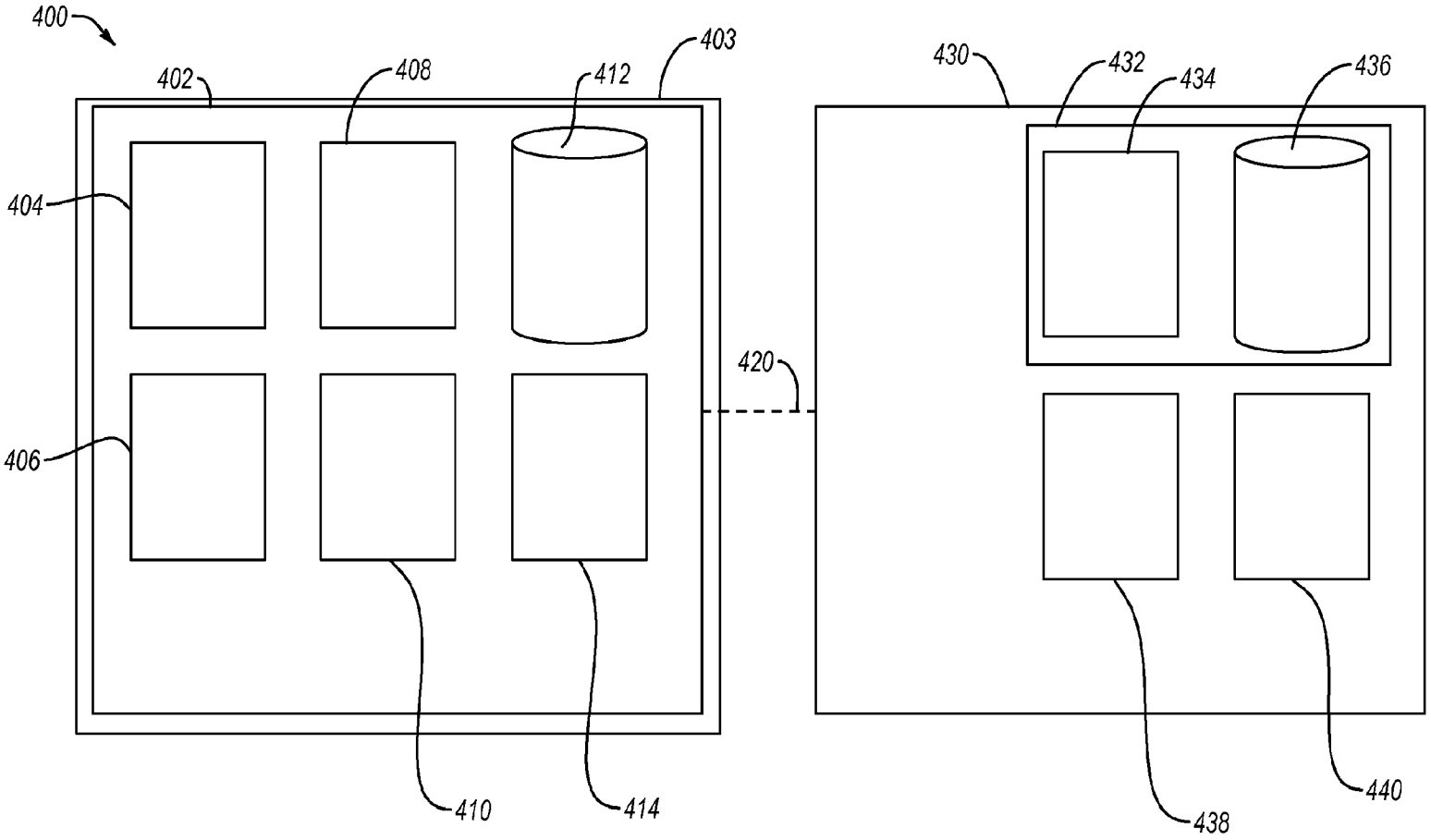
FIG. 5 illustrates a block diagram of a free weight system according to the present invention.

FIG. 5 illustrates a block diagram of free weight system 400. Free weight system 400 includes a data collecting mechanism 402, which may be housed in whole or in part within a free weight apparatus 403, such as a dumbbell, bar bell, curl bell, etc. Data collecting mechanism 402 includes a movement sensing mechanism 404, a timer 406, a weight identification mechanism 408, an exercise session identification mechanism 410, a memory 412, and a battery 414. Movement sensing mechanism 404 may comprise one or more accelerometers that track movement in a plurality of directions. For example, movement sensing mechanism 404 may include one or more accelerometers that track movement of free weight apparatus 403 along an x-axis, a y-axis, and a z-axis during an exercise session. Timer 406 may track the amount of time that elapses during an exercise session. Weight identification mechanism 408 may identify the weight of the free weight apparatus 403. Exercise session identification mechanism 410 may identify an initiation and termination of an exercise session.

Information from movement sensing mechanism 404, timer 406, and weight identification mechanism 408 may be sent for temporary or long term storage to memory 412. Memory 412 may comprise flash memory, RAM, ROM, EEPROM or any other medium which can be used to store data. All or a portion of the data that is stored in memory 412 may be transmitted via a communication connection 420 to an external computing device 430. Communication connection 420 may be a wired or wireless connection, or another type of communication connection such as a memory card that may be inserted into compatible ports on both the free weight apparatus and external computing device 430.

External computing device 430 may be a personal computer, a telephone, a media player, or another type of computing apparatus. External computing device 430 includes a processor 432, which may comprise a software application 434 and a memory 436. External computing device 430 also includes a user input mechanism 438 and a display 440. User input mechanism 434 may include a keyboard or a mouse. Software application 434 may analyze and/or convert some or all of the data received from data collecting mechanism 402 into a displayable representation of the data. For example, the number of repetitions performed, the duration of the exercise session, the time between repetitions, calories burned, power exerted, watts, and the like may be displayed numerically on display screen 440. Additionally, or alternatively, data relating to the information received from data collecting mechanism 402 may be displayed graphically. The graph displaying some or all of the data received from data collecting mechanism 402 may include three-dimensional and/or two dimensional representation of the movement of a free weight apparatus.

Figure 6A:
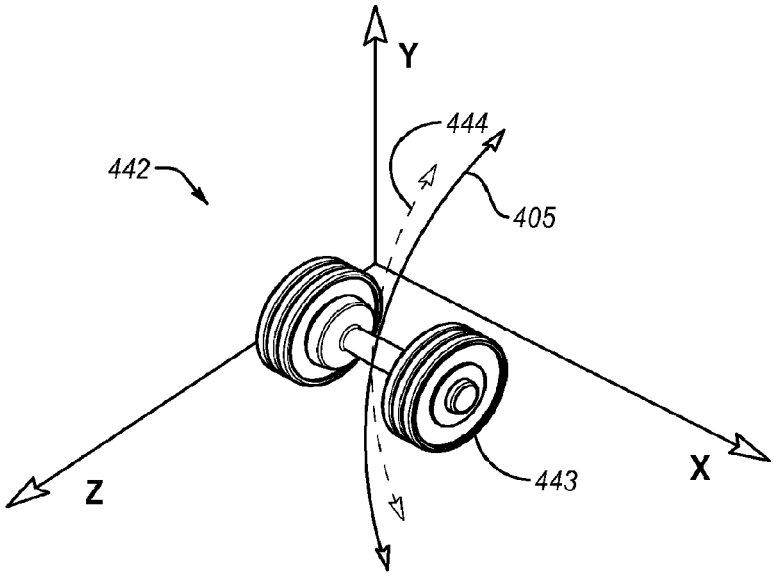
FIG. 6A illustrates a three dimensional form of displayable data according to the present invention.

For example, FIGS. 6A-6D illustrate the different views that may be provided on display screen 440. Specifically, FIG. 6A illustrates a three-dimensional view 442 of the movement of a free weight apparatus 443. The x-axis shows side to side movement of free weight apparatus 443, the y-axis shows up and down movement of free weight apparatus 443, and the z-axis shows forward and backward movement of free weight apparatus 443. An arrow 444 shows the path that free weight apparatus 443 traveled during the exercise session. Arrow 444 may be shown on display 440 or free weight apparatus 443 may move on display screen 440 at the rate and in the directions that a user actually moved free weight apparatus 443 during the exercise session thereby, in effect, recreating the exercise session. User input mechanism 434 may be used to select the viewing angle of the workout session recreation.

Figure 6B:
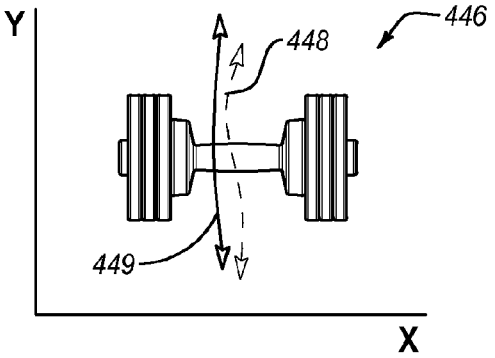
FIG. 6B illustrates a two dimensional form of displayable data from a first perspective according to the present invention.

A user may also select a front view 446 of the workout session recreation, which is illustrated in FIG. 6B. Because of the viewing angle, front view 446 is a 2-dimensional illustration of the workout session recreation. Front view 446 illustrates the up and down movement (y-axis) and the side to side movement (x-axis) of free weight apparatus 443. The path that free weight apparatus travels from front view 446 is shown with an arrow 448.

Figure 6D:
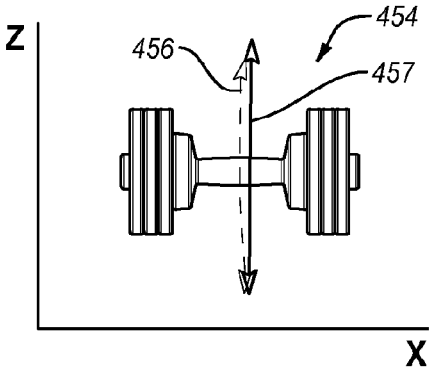
FIG. 6D illustrates a two dimensional form of displayable data from a third perspective according to the present invention.
Figure 6C:
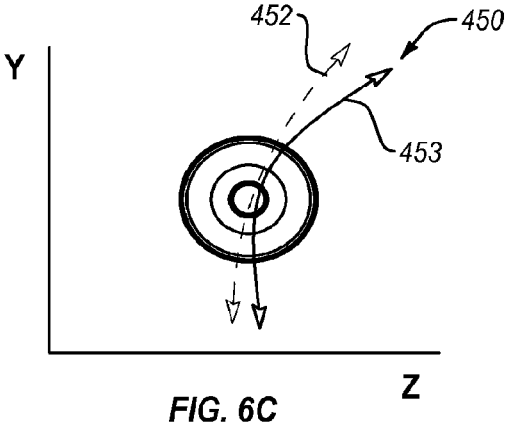
FIG. 6C illustrates a two dimensional form of displayable data from a second perspective according to the present invention.

Similarly, a user may select a side view 450 of the workout session recreation, which is illustrated in FIG. 6C. Because of the viewing angle, side view 450 is a 2-dimensional illustration of the workout session recreation. Side view 450 illustrates the up and down movement (y-axis) and forward and backward movement (z-axis) of free weight apparatus 443. The path that free weight apparatus travels from side view 450 is shown with an arrow 452.

Still further, a user may select a top view 454 of the workout session recreation, which is illustrated in FIG. 6D. Because of the viewing angle, top view 454 is a 2-dimensional illustration of the workout session recreation. Top view 454 illustrates the side to side movement (x-axis) and forward and backward movement (z-axis) of free weight apparatus 443. The path that free weight apparatus travels from top view 454 is shown with an arrow 456.

In addition to an actual representation of the path that that free weight apparatus 443 traveled during an exercise session, display screen 440 may also provide an ideal path for the particular exercise session. Providing an ideal path for an exercise session may require that certain information be input into external computing device 430. For example, information regarding the type of exercise performed and possibly some details about the user (such as height, weight, arm length, and the like) may be required. This information may be input using user input mechanism 438.

Once this information is input, software application 434 may create and display graphically an ideal path of movement for free weight apparatus 443. The ideal path of movement for free weight apparatus 443 may be overlaid on top of a graph showing a user's actual path. For example, arrow 405 may show an ideal path of travel for free weight apparatus 443 in FIG. 6A. Arrow 449 may show an ideal path of travel for free weight apparatus 443 in FIG. 6B. Arrow 453 may show an ideal path of travel for free weight apparatus 443 in FIG. 6C. Arrow 457 may show an ideal path of travel for free weight apparatus 443 in FIG. 6D. Alternatively, the ideal path may be displayed in a separate graph that appears together with or separate from a graph showing the user's actual path.

In addition, software application 434 may also perform an analysis of the data received from data collecting mechanism 402 and provide recommendations and suggestions for improvement. For example, after an analysis of the received from data collecting mechanism 402, a message may appear on display screen suggesting that the user slow the repetitions down or improve his or her form in some way.

Figure 7:
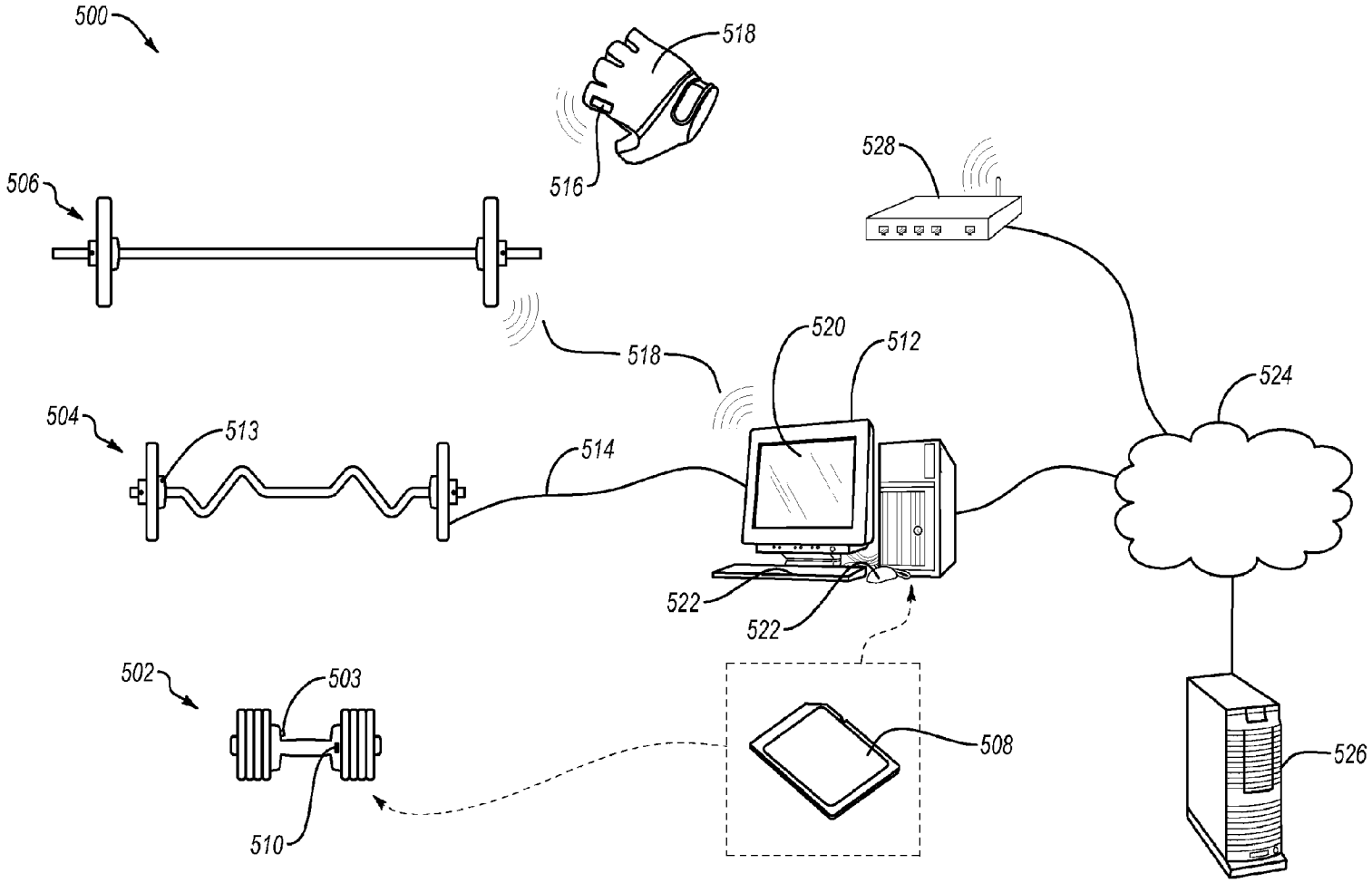
FIG. 7 illustrates a perspective view of another free weight system according to the present invention.

FIG. 7 illustrates a free weight system 500. Free weight system 500 includes a dumbbell 502, a curl bar 504, and a bar bell 506. Dumbbell 502 includes an exercise session identification mechanism, a data collecting mechanism, and a communication mechanism. The exercise session identification mechanism in dumbbell 502 comprises a button 503. The communication mechanism in dumbbell 502 comprises a memory card 508, which may be inserted into a memory card port 510 on dumbbell 502. When memory card 508 is engaged within memory card port 510, data collected by the data collecting mechanism in dumbbell 502 may be uploaded to memory card 508. Memory card 508 may transfer this data to an external computing device 512, which may also have a port compatible with memory card 508.

Curl bar 504 also includes an exercise session identification mechanism, a data collecting mechanism, and a communication mechanism. The exercise session identification mechanism in curl bar 504 comprises a voice recognition system 513. Thus, a user may initiate and/or terminate a workout session by simply stating "begin workout," "end workout," or the like. The communication mechanism in curl bar 504 comprises a wire 514, which may be inserted into data ports on dumbbell 502 and external computing device 512. Information gathered by the data collecting mechanism in curl bar 504 may be transmitted via wire 514 to computing device 512.

Bar bell 506 also includes an exercise session identification mechanism, a data collecting mechanism, and a communication mechanism. The exercise session identification mechanism in bar bell 506 comprises a button 516 that is secured to a glove 518. Glove 518 may wirelessly communicate data from button 516, including the initiation and/or termination of a workout session, to a receiver in bar bell 506. This wireless communication between glove 518 and bar bell 506 may be via Bluetooth, RFID, IR, or another wireless mechanism. The communication mechanism in bar bell 506 may send a wireless signal 518 from a transmitter within bar bell 506, which is received by a receiver in external computing device 512. Information gathered by the data collecting mechanism in bar bell 506 may be transmitted via wireless signal 518 to computing device 512 periodically during an exercise session or upon completion of the exercise session.

External computing device 512 includes a display screen 520 and user input mechanisms 522. External computing device 512 may store the data received via memory card 508, wire 514, wireless connection 518 within external computing device 512. External computing device 512 may also include a software application that analyzes and/or converts the data from dumbbell 502, curl bar 504, and bar bell 506 into a displayable form. In addition or alternatively, external computing device 512 may transmit data received from dumbbell 502, curl bar 504, and bar bell 506 to a communication system 526. Communication system 526 may comprise, for example, a website. External computing device 512 may access communication system 526 via a network 524. Network 524 may comprise, for example, the Internet.

Communication system 526 may store data received from dumbbell 502, curl bar 504, and bar bell 506. Further, communication system 526 may include a software application that analyzes and/or converts this data into a displayable form. Communication system 526 may make the displayable data and/or analysis available to any computing device that can communicate with network 524. Dumbbell 502, curl bar 504, and bar bell 506 may upload data directly to communication system 526 through network 524. For example, bar bell 506 may also communicate with a wireless router 528, which is connected to communication system 526 directly via network 524. Thus, external computing device 512 is not required to transmit data to communication system 526.

INDUSTRIAL APPLICABILITY

In general, the present invention relates to free weight systems that collect exercise related data from an exercise session with a free weight device and that transmit the data to an external location for analysis and display. The free weight systems of the present invention may include a free weight device, a data collecting mechanism, and a communication mechanism. The free weight device may include, for example, a dumbbell, a curl bar, a bar bell, and the like.

The free weight device may include a handle assembly. A handle assembly may include a gripping portion, left and right weight receiving portions, and/or left and right collar members. One will appreciate that a gripping portion of a free weight handle assembly can vary in size and shape. For example, a gripping portion may be sized to be gripped in one hand of a user. In other embodiments of the present invention, a gripping portion may be sized to be held by two hands, such as a barbell for use in performing bench press type exercises, a curl bar for use in performing curl type exercises, etc. One will also appreciate that a gripping portion may be bent or curved to accommodate various weight training exercises and hand placements.

Left and right weight receiving portions may be configured to receive one or more weight plates. The weight plates may have an aperture that fits around the left and right weight receiving portions. Alternatively, the free weight device may include a fixed amount of weight that is not selectively variable, as is the case with some dumbbells. The handle assembly may define an internal cavity. This internal cavity may be limited to a single component of the handle assembly (for example, only within the gripping portion), or it may extent throughout several different components of the handle assembly.

The internal cavity, regardless of its size, shape, or location within the handle assembly, houses in whole or in part the data collecting mechanism. The data collecting mechanism may include a movement sensing mechanism. The movement sensing mechanism may use accelerometers, gyroscopes, and the like to sense movement. One or more accelerometers, gyroscopes, and the like may be used to track movement in a plurality of different directions. For example, a movement sensing mechanism may include one or more accelerometers that track movement on an x-axis, a y-axis, and a z-axis. Data collected by the movement sensing mechanism may be used to identify, for example, a repetition performed by a user during an exercise session with the free weight device. The data collecting mechanism may also include a timer that tracks the time of an exercise session as well as the time between events (e.g., repetitions) identified by the movement sensing mechanism.

The data collecting mechanism may also include an exercise session identification mechanism. The free weight device may undergo movements that are unrelated to a user's exercise session with the free weight device. Thus, in order for the movement sensing mechanism to correctly track the free weight device's movements during the exercise session, a signal may be provided to the movement sensing mechanism by the exercise session identification mechanism that causes the movement sensing mechanism to begin or cease collecting data. The exercise session identification mechanism may comprise a button that a user presses. This button may be located anywhere on the free weight device. The button may also be located external to the free weight device. For example, the button may be located on a glove, ring, bracelet, watch, and the like. The exercise session identification mechanism may also be voice activated such that a user need only say a word or words to initiate/terminate an exercise session.

The data collecting mechanism may further include a weight identification mechanism that identifies the amount of weight of one or more weight plates that are attached to a left and/or a right weight receiving portion. The weight identification mechanism may require user input. For example, a weight identification mechanism may include a panel that includes buttons that a user may press to identify the amount of weight on a free weight device. The panel may be located on the free weight device or it may be external from the free weight device. The panel may include a display that shows the amount of weight entered.

Alternatively, the weight identification mechanism may automatically sense a weight from a signal received from a weight plate. For example a weight plate may have a transmitter on a lateral side or inner portion that communicates with a receiver on a free weight handle assembly. For example, the sensor may be positioned on or in a collar member that is positioned between a gripping portion and a left and/or right weight receiving portion. Alternatively, the sensor may be positioned on or in a left or right weight receiving member. The sensor may communicate with a weight plate via an RFID communication. The sensor may also comprise a pressure switch that is able to sense the weight of the weight plates. The weight handle assembly may also include a display screen that shows how much weight has been detected to ensure accuracy.

A battery may also be enclosed in whole or in part in an internal cavity within a free weight handle assembly. The battery may be removed and replaced via a door that provides access to the internal cavity. Alternatively, the battery may be rechargeable without the need to remove the battery from its position within the free weight handle assembly. The battery may be in electrical communication with a charging port which may be connected to a charging plug. The charging plug may be located on a base member that also serves as a cradle for the free weight device when not in use.

Data collected from the data collecting mechanism may be transmitted via a communication mechanism to an external computing device. A communication mechanism may transmit data via a wireless communication link, a wired communication link, a removable memory card such as an SD card, a USB drive, and the like. The external computing device may be a personal computer, a phone, a media player, a communication system such as a website and the like. The free weight device may include software that analyzes the data and converts it into a displayable form. The free weight device may include a display screen, or may be connected to a display screen, that presents the data in the displayable form.

Alternatively, the external computing device may include software that analyzes the data received from the data collecting mechanism and converts it into a displayable form of information regarding a workout session with the free weight device. For example, software may provide data regarding the number of calories burned, the watts, power, workout session time, number of repetitions, number of sets, and the like.

The external computing device may include a display screen and one or more user input devices, such as a keyboard and mouse. Alternatively, the external computing device may simply convert the data into a displayable form. Such is the case in a system where the data collecting mechanism transmits data either directly or indirectly to a website. The website may make the displayable information available to any computing device that is able to access the website and that has a display screen. A telephone or a media player, for example, may access the website and display the information available.

The information displayed may include a graphical representation of the movement of the free weight device during the exercise session. The graphical representation may be 3-dimensional or 2-dimensional. The graphical representation may include an ideal movement path for the free weight device. Providing the ideal path may require that the user input certain information, such as the type of exercise performed, the user's height, arm length, and the like. This information may be input through user input controls, such as buttons, located on or connected to the free weight device. Alternatively, this information may be input through user input controls on an external computing device. The displayable data may also include numbers, letters, and/or symbols that relate to the exercise session. For example, displayable data may include a number of calories burned, number of repetitions, and the like. Displayable data may further include encouragement and/or suggestions for improvement. For example, the software may analyze the data and suggest an improvement for performing an exercise. For example, a suggestion to slow the movement down may be provided via the display screen.

The invention claimed is:

1. A free weight system for collecting and transmitting exercise related data from a free weight device, the system comprising:

a free weight handle assembly that includes a gripping portion, a left weight receiving portion, and a right weight receiving portion, wherein the gripping portion is positioned between the left and right weight receiving portions and wherein the free weight handle assembly defines an internal cavity;

one or more weight plates positionable on the left and right weight receiving portions; and a data collecting mechanism at least partially enclosed within the internal cavity, the data collecting mechanism including a weight identification mechanism that identifies the weight of the one or more weight plates;

wherein the weight identification mechanism includes a sensor enclosed within the internal cavity and a magnet located in one of the weight plates, the magnet being spaced a distance from the sensor;

wherein the distance of the magnet provides a relative magnetic field strength that correlates with the weight of the weight plate.

2. The free weight system of claim 1, wherein the data collecting mechanism further comprises a movement sensing mechanism that senses movement of the free weight handle assembly.

3. The free weight system of claim 2, wherein the movement sensing mechanism comprises a first accelerometer that measures movement in a first direction, a second accelerometer that measures movement in a second direction, and a third accelerometer that measures movement in a third direction.

4. The free weight system of claim 1, wherein the data collecting mechanism further comprises an exercise session identification mechanism that identifies the initiation and termination of an exercise session.

5. The free weight system of claim 4, wherein the exercise session identification mechanism comprises a button positioned on a surface of the free weight handle assembly.

6. The free weight system of claim 4, wherein the exercise session identification mechanism comprises a button that is positioned on a glove external to the free weight handle assembly.

7. The free weight system of claim 1, wherein the weight identification mechanism further comprises a panel secured to a surface of the free weight handle assembly, the panel having one or more buttons to identify an amount of weight of the one or more weight plates.

8. The free weight system of claim 7, wherein the panel further comprises a display screen.

9. The free weight system of claim 2, wherein the data collecting mechanism further comprises a memory where data collected from at least one of the movement sensing mechanism and the weight identification mechanism is stored.

10. The free weight system of claim 9 further comprising a communication mechanism, wherein the communication mechanism transmits data collected by the data collecting mechanism to an external computing device.

11. The free weight system of claim 10, wherein at least a portion of the data stored within the memory is transmitted via the communication mechanism to the external computing device.

12. The free weight system of claim 11, wherein the communication mechanism transmits said at least a portion of the data stored within the memory via a wireless communication link.

13. A free weight system for collecting, transmitting, and making available for viewing exercise related data, the system comprising:

a free weight device including a free weight handle assembly, a communication mechanism, and a movement sensing mechanism;

wherein the movement sensing mechanism includes a first accelerometer that measures movement from an exercise session in a first direction, a second accelerometer that measures movement in a second direction, and a third accelerometer that measures movement in a third direction;

wherein the free weight handle assembly defines an internal cavity that at least partially encloses the movement sensing mechanism;

wherein the communication mechanism transmits data collecting by the movement sensing mechanism;

a communication system that receives the data collected by the movement sensing mechanism and transmitted by the communication mechanism, wherein the communication system converts the data received into a displayable form that includes a graphical representation of the exercise session and makes the graphical representation available for viewing; and a weight identification mechanism, including a sensor enclosed within the internal cavity and a magnet located in one of the weight plates, the magnet being spaced a distance from the sensor;

wherein the distance of the magnet provides a relative magnetic field strength that correlates with the weight of the weight plate.

14. The free weight system of claim 13, wherein the graphical representation includes a three dimensional representation of the actual path of movement of the free weight device during the exercise session.

15. The free weight system of claim 14, wherein the communication system creates an ideal path of movement for the free weight device during the exercise session.

16. The free weight system of claim 15, wherein the actual path of movement and the ideal path of movement are overlaid within the same graphical display.

17. The free weight system of claim 13, wherein the communication system comprises a website.

* * * * *